United States Patent [19]

Nelson

[11] 4,073,169

[45] Feb. 14, 1978

[54] BALL-OPERATED LABYRINTHIC LOCK

[76] Inventor: Lyle C. Nelson, 1928 Cooper Plaza, Bend, Oreg. 97701

[21] Appl. No.: 707,294

[22] Filed: July 21, 1976

[51] Int. Cl.[2] ..... B65D 55/02; E05B 37/20

[52] U.S. Cl. ..... 70/166; 46/43; 70/290; 206/1.5

[58] Field of Search ..... 70/166, 63, 276, 289, 70/290, 163; 206/1.5; 46/43; 273/153 R

[56] References Cited

U.S. PATENT DOCUMENTS

| | | | |
|---|---|---|---|
| 474,941 | 5/1892 | Bartholomew | 70/289 X |
| 612,572 | 10/1898 | Robertson | 70/289 |
| 1,733,772 | 10/1929 | Battershell | 206/1.5 |
| 2,499,765 | 3/1950 | Maclaren | 70/290 X |
| 3,234,767 | 2/1966 | Allander | 70/276 |
| 3,787,050 | 1/1974 | Goldfarb | 46/43 X |

FOREIGN PATENT DOCUMENTS

| | | | |
|---|---|---|---|
| 947,437 | 1/1949 | France | 70/289 |
| 820,398 | 11/1951 | Germany | 206/1.5 |
| 428,438 | 12/1947 | Italy | 70/290 |
| 16,500 of | 1802 | United Kingdom | 70/290 |

OTHER PUBLICATIONS

"Wizards Boxes" Taken from Popular Science, Mar. 1953, pp. 188–191.

*Primary Examiner*—Roy D. Frazier
*Assistant Examiner*—Thomas J. Holko
*Attorney, Agent, or Firm*—Chernoff & Vilhauer

[57] ABSTRACT

A locking device including a labyrinthic passageway through which a ball may be moved until arriving at a position adjacent an associated locking mechanism that is operable solely in response to the presence of the ball. In an exemplary embodiment, the labyrinthic passageway is concealed in the bottom of an open-topped walled container and the locking mechanism is in communication with a sliding plate member employed to close the container. With the plate member in its closed position and the ball placed at a starting location within the passageway, yet away from the locking mechanism, the container cannot be opened until the ball has been encouraged, by spatial manipulation of the container, to negotiate the labyrinth, arrive at a position adjacent the locking mechanism, and operate same solely by the impression of its weight thereupon.

7 Claims, 3 Drawing Figures

BALL-OPERATED LABYRINTHIC LOCK

BACKGROUND OF THE INVENTION

The present invention relates to a means for preventing the operation of a locking mechanism until a ball has been successfully moved through a labyrinthic passageway. Several devices have been developed that employ a ball to lock or unlock two or more interconnected members. Examples of such devices include those disclosed by La Montagne U.S. Pat. No. 3,650,379, Hein U.S. Pat. No. 2,709,357, Maclaren U.S. Pat. No. 2,499,765, and Frederiksen U.S. Pat. No. 698,486. The most pertinent of these known prior art devices is that disclosed by Frederiksen as comprising a rotatable labyrinthic enclosure through which a ball may be encouraged, by rotation of the enclosure, to move until arriving at a position where it may be employed, by a separate and distinct operator-exerted force, to unlatch an associated locking mechanism. The remaining three prior art devices each employ one or more balls as obstructing elements to prevent the separation of interconnected members until the balls have been moved to predetermined positions within the device.

SUMMARY OF THE INVENTION

The locking device of the present invention is directed to a ball-operated lock of the type wherein a ball is moved through labyrinthic passageway to a position where it can operate, without further operator intervention, an associated locking mechanism. More particularly, the device of the present invention comprises a labyrinthic passageway, a ball residing in and movable therethrough by spatial manipulation of the passageway, and an associated locking mechanism that is operable solely in response to the proximate presence of the ball. In the disclosed exemplary embodiment, the labyrinthic passageway is concealed in the bottom of an open-topped container, and a movable locking member extends from the passageway to a position of selective latchable engagement with a slidably removable top plate employed to close the container. The locking member is biased in its locked position such that, when the top member is in place and latchably engaged by the locking member, the top member cannot be displaced, and thus the container cannot be opened, until the locking member has been moved to its unlocked position. Such movement of the locking member is accomplished by predetermined spatial orientation of the container so as to encourage the ball residing in the concealed passageway to negotiate the labyrinth from an initial starting position away from the locking member to an ending position adjacent the locking member. Once the ball reaches its ending position adjacent the locking member, the weight of the ball acts upon a portion of the locking member extending into the passageway and causes the locking member to move to its unlocked position. In contrast to the prior art labyrinth locking devices referred to above, no manipulation of the container nor of any additional element associated therewith, other than the spatial manipulation necessary to move the ball through the passageway, is required to operate the locking member and release the top plate. With the locking member in its unlocked position, the top plate may be removed and the container opened.

The container incorporating the locking device of the present invention may be employed as a means for protecting valuables, as a child's educational and amusing toy, or as a novelty item. When used to protect valuables, its security against unauthorized operation is assured by the difficulty attendant with moving the ball through the complex labyrinthic passageway without having a prior knowledge of the path described thereby. This security is further enhanced by the concealment of the passageway and ball within the container, thereby preventing a person watching the device being operated from ascertaining readily the method of its operation. When use as a child's toy or novelty item, the passageway could describe a simplified path in order to make the device interesting and challenging yet relatively simple to operate. The locking device of the present invention may also be adapted for use with other types of lockable containers such as suitcases, briefcases and the like.

Although the locking device of the present invention has been discussed above in the context of a weight-operated locking member, it is understood that other means, such as electrical, magnetic or optical sensors, could be employed as well to activate the locking mechanism solely in response to a detected presence of the ball at a predetermined location within the passageway.

It is, therefore, a principal objective of the present invention to provide a novel locking device that is operable solely in response to the presence at a predetermined location of a ball that has been encouraged to successfully negotiate a labyrinthic passageway.

It is an additional objective of the present invention to provide a lockable container utilizing a locking device of the type described.

It is a further objective of the present invention to provide a child's toy or novelty item utilizing a locking device of the type described.

It is an advantage of the locking device of the present invention that it may be operated in the presence of another person without necessarily disclosing the method of its operation.

The foregoing objectives, features and advantages of the present invention will be more readily understood upon consideration of the following detailed description of the invention taken in conjunction with the accompanying drawings.

DETAILED DESCRIPTION OF AN EXEMPLARY EMBODIMENT

Figure 1:
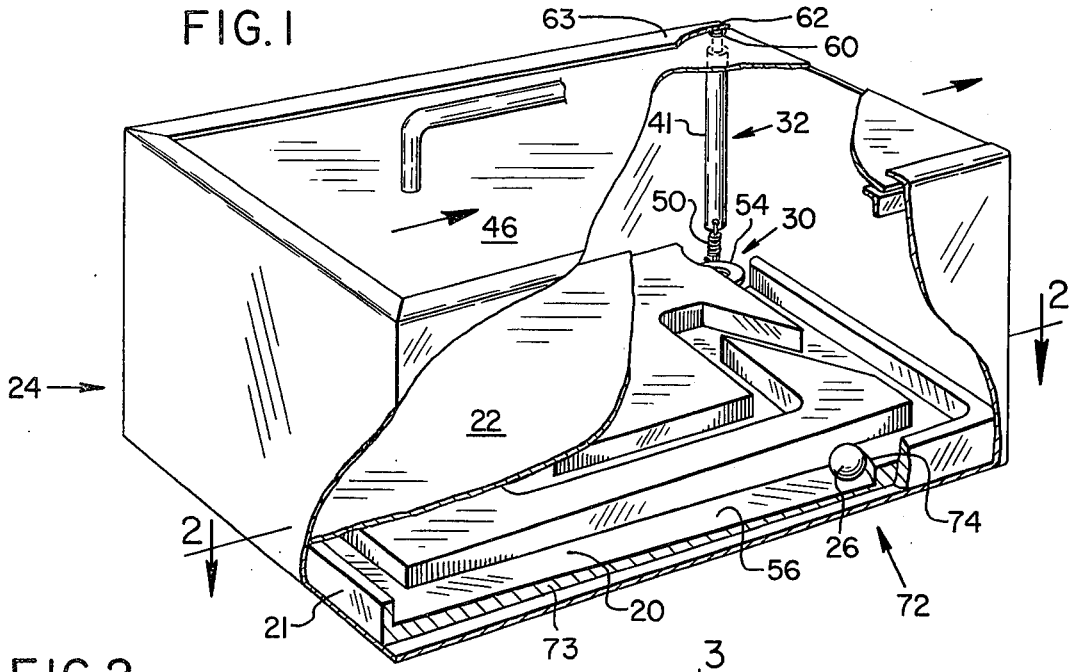
FIG. 1 is a partially cut-away perspective view of a lockable container incorporating an exemplary embodiment of the locking device of the present invention.

As shown in the figures, an exemplary embodiment of the locking device of the present invention comprises a labyrinthic passageway 20 formed in a floor member 21 and concealed under the false bottom 22 of a surrounding open-topped container 24, a ball 26 residing in and movable through the passageway upon spatial orientation of the container, and a locking mechanism 32 located proximate one end 30 of the passageway and operable solely in response to the adjacent presence of the ball. The locking mechanism 32 includes a rod member 40 mounted in a surrounding tubular housing 41 affixed to the container 24. A first portion 42 of the rod 40 extends laterally into the passageway 20 and a second portion 44 extends upwardly from the passageway through the housing 41, to a position of selective latching engagement, when the rod is in the locked position shown in the figure, with a cover plate 46 employed to close the top of the container 24. A hole 60 is formed proximate one corner of the cover plate 46 to receive the upper end 62 of the rod 40, and a flange 63, shown partially cut away in FIG. 1, serves to limit the upward movement of the rod and also to protect the rod from unauthorized manipulation.

Figure 3:
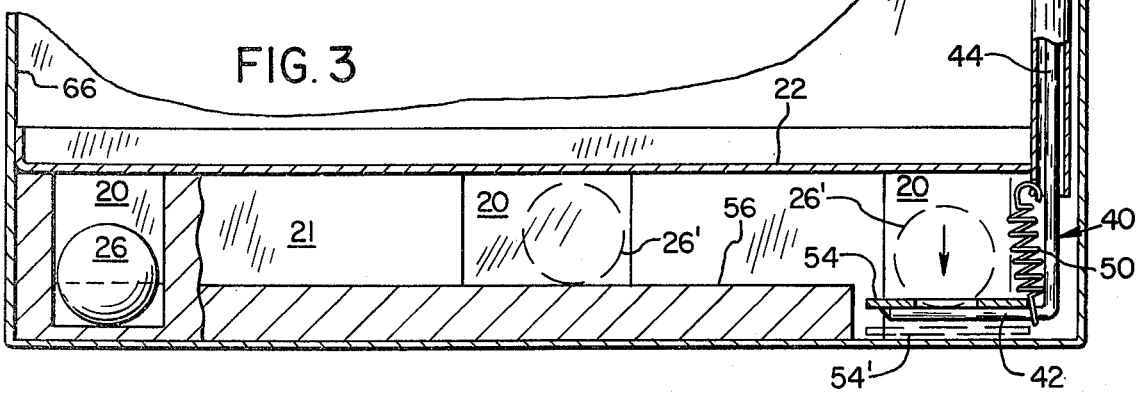
FIG. 3 is a partial secional view taken along line 3—3 of the container of FIG. 2.

The rod 40 is biased in its upward locked position by a spring 50 connected in tension between the rod and the surrounding tubular housing 41. A washer 54 or other suitable platform element is attached to the portion 42 of the rod 40 extending into the passageway 20 to facilitate the positioning thereon of the ball 26 when the ball has been moved to the end 30 of the passageway. The upper surface of this washer 54 is maintained at or slightly below the lower surface 56 of the passageway 20, as shown in FIG. 3, to permit ready transfer of the ball 26 from the passageway to the washer. The spring constant of the bias spring 50 is matched to the weight of the ball 26 such that the pressure of the ball on the washer 54 will move the rod 40 to its lower or unlocked position, indicated by the dashed outline of the washer 54 in FIG. 3, thereby withdrawing the rod tip 62 from the cover plate hole 60. When the ball 26 is at any other location within the passageway 20, the rod 40 will remain biased upwardly and, assuming the top plate is in its fully closed position, the container 24 will remain locked.

A groove 64 formed partway around the upper edge of the container 24 serves to retain the cover plate 46 in its closed position, while still permitting its ready removal when the container is unlocked. If desired, a stop member or other suitable means may be provided on the top plate 46 to prevent the complete removal of the top plate from the groove 64. Moreover, a side plate or end plate may be adapted for removal instead of the top plate. In either case, the removable plate may be hingedly rather than slidably mounted, and spring biased for automatic movement to an open position upon operation of the locking mechanism 32.

To lock the container 24, the ball 26 is moved, by selective spatial orientation of the container 24, to a position atop the washer 54, thereby moving the rod 40 of the locking mechanism 32 to its unlocked position, and the top plate 46 is slid to its fully closed position. The ball 26 is then moved, by further spatial orientation of the container 24 from the washer 54 to an initial starting position 72 away from the locking mechanism 32. A step 74 formed in the passageway 20 by depressing a portion of the passageway floor 56 serves as a blocking means to prevent the ball 26 from returning to a position adjacent the locking mechanism 32 without first negotiating the labyrinth in a forward direction as described more fully below. Other unilateral ball-retaining means, such as a movable flap or gate member, could be employed at the starting position 72 as well. Once the ball 26 is moved from the washer 54, the rod 40 moves upwardly by the force of the bias spring 50 to a locked position with its tip 62 inserted into the top plate hole 60, thereby preventing the top plate from being moved toward its open position.

Figure 2:
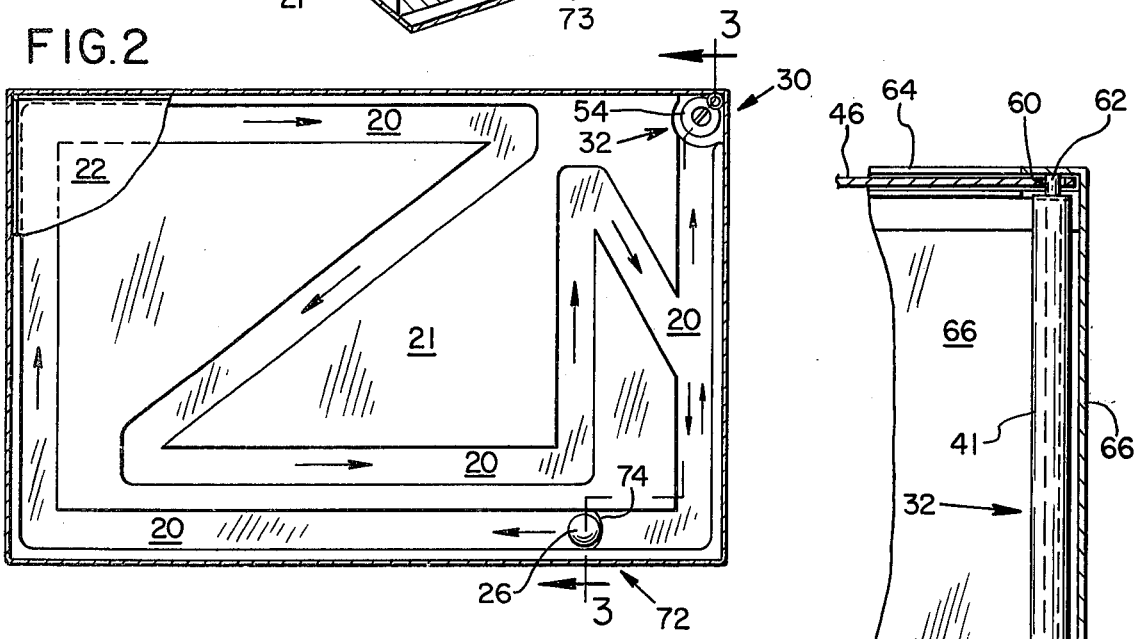
FIG. 2 is a sectional view taken along line 2—2 of the container of FIG. 1.

To unlock the container, the ball 26 is moved, by renewed selective spatial orientation of the container, from its starting position 72 through the passageway 20 in a forward direction up ramp 73, as indicated by the arrows of FIG. 2, until returning to a position atop the washer 54. When the ball is again so positioned, its weight will overcome the force of the bias spring 50 and cause the rod 40 to move downwardly until the upper end 62 of the rod has been withdrawn from the hole 60 in the cover plate 46, thereby unlocking the container.

It is understood that ball sensing devices other than the extending portion 42 of the rod 40 could be employed to operate the locking mechanism 32 solely in response to the adjacent presence of the ball 26 without departing from the invention as disclosed. Moreover, as indicated earlier, other portions of the container 24, for example a side or end member, could serve as the opening member in place of the top plate.

The terms and expressions which have been employed in the foregoing abstract and specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A locking device for preventing the unauthorized release of locking means associated therewith, said device comprising:

a. means defining a labyrinthic passageway having a starting end and a finish end;

b. a ball residing in said labyrinthic passageway means and movable therethrough;

c. said labyrinthic passageway means defining a ramp over at least a portion of its extent, extending upwardly between said starting end and said finish end;

d. means defining a reset passageway for permitting passage of said ball between said finish end and said starting end without reversely negotiating said labyrinthic passageway means, said reset passageway means interconnected at one of its ends to said starting and interconnected medially to said finish end;

e. locking means associated with the other end of said reset passageway means, releasable in response to the adjacent presense of said ball at said other end of said reset passageway.

2. The locking device of claim 1 including step means associated with said reset passageway means, for preventing passage of said ball from said starting end to said finish end through said reset passageway means.

3. The locking device of claim 1 wherein said movement of said ball through said labyrinthic passageway means is accomplished by selective manipulation of the spatial orientation of said labyrinthic passageway means.

4. The locking device of claim 1 further comprising means for concealing said labyrinthic passageway means from view such that the position of said ball therein is indiscernible by direct visual observation.

5. The locking device of claim 1 wherein said closure means comprises a plate member positionable over said open side of said container, and wherein said container includes means for receiving and retaining said plate member.

6. The locking device of claim 1 further comprising enclosure means for surrounding said labyrinthic passageway means and defining a container that is open at one side, and closure means for closing said open side of said container, said locking device adapted for releasable engagement with said closure means.

7. The locking device of claim 6 wherein said locking means comprises:

a. a latchable member forming a part of said closure means;

b. a locking member extending between said reset passageway means and said latchable member, said locking member being movable between a first position of locking engagement with said latchable member and a second position free of said latchable member; and c. activating means associated with said locking member for moving said locking member between said first position and said second position, said activating means extending into said reset passageway means for operable engagement with said ball moving therethrough, said activating means arranged for being movable from said first position to said second position solely in response to the weight of said ball thereon.

* * * * *

UNITED STATES PATENT AND TRADEMARK OFFICE

CERTIFICATE OF CORRECTION

PATENT NO. : 4,073,169

DATED : February 14, 1978

INVENTOR(S) : Lyle C. Nelson

It is certified that error appears in the above-identified patent and that said Letters Patent are hereby corrected as shown below:

| | |
|---|---|
| Col. 2, Line 51 | Change "secional" to --sectional--. |
| Col. 3, Line 23 | Change "pressure" to --presence--. |

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*